US010329809B2

(12) United States Patent
Ramsauer

(10) Patent No.: US 10,329,809 B2
(45) Date of Patent: Jun. 25, 2019

(54) ROD GUIDE

(71) Applicant: Dieter Ramsauer, Schwelm (DE)

(72) Inventor: Dieter Ramsauer, Schwelm (DE)

( * ) Notice: Subject to any disclaimer, the term of this patent is extended or adjusted under 35 U.S.C. 154(b) by 863 days.

(21) Appl. No.: 14/415,920

(22) PCT Filed: Jun. 21, 2013

(86) PCT No.: PCT/EP2013/001841
§ 371 (c)(1),
(2) Date: Jan. 20, 2015

(87) PCT Pub. No.: WO2014/015930
PCT Pub. Date: Jan. 30, 2014

(65) Prior Publication Data

US 2015/0184435 A1 Jul. 2, 2015

(30) Foreign Application Priority Data

Jul. 21, 2012 (DE) ..... 20 2012 007 098 U

(51) Int. Cl.
*E05C 9/22* (2006.01)
*E05B 63/00* (2006.01)

(52) U.S. Cl.
CPC ..... *E05C 9/22* (2013.01); *E05B 63/0017* (2013.01); *E05B 63/0056* (2013.01); *Y10T 292/62* (2015.04)

(58) Field of Classification Search
CPC ..... E05B 63/0017; E05C 9/22; Y10T 292/62; Y10T 403/4391; Y10T 403/71;
(Continued)

(56) References Cited

U.S. PATENT DOCUMENTS 476,037 A 5/1892 Colton
1,954,739 A * 4/1934 Lyons ..... E05F 11/12 292/305

(Continued)

FOREIGN PATENT DOCUMENTS

DE 20 2007 005 424 8/2008
EP 0 035 175 6/1984

OTHER PUBLICATIONS

International Search Report for Application No. PCT/EP2013/001841 dated Nov. 11, 2013.

*Primary Examiner* — Amber R Anderson
*Assistant Examiner* — Nahid Amiri
(74) *Attorney, Agent, or Firm* — Haug Partners LLP

(57) ABSTRACT

A rod guide for guiding lock rods at sheet metal cabinet doors or the like, including a carrier which can be fixed on the inner surface of the door leaf, and a guide element which can be mounted on the carrier. The guide element forms a housing and has a guide surface having an adjustable distance from the inner surface of the door leaf when the rod is assembled. The carrier is a stud bolt or welded stud with a circumferential thread, onto which stud bolt an adjusting screw or adjusting nut is screwed or can be screwed. The adjusting screw or the adjusting nut is rotatably supported in the housing or guide element. The adjusting screw or adjusting nut has a circumferential surface for turning the adjusting screw or adjusting nut manually, which circumferential surface is accessible from the outside and is roughened or knurled or edged.

12 Claims, 16 Drawing Sheets

(58) Field of Classification Search
CPC ..... Y10T 403/7129; Y10T 403/7141; Y10T 403/7171; Y10T 403/7188; Y10T 403/7194; Y10T 403/60; Y10T 403/61; Y10T 403/7039; Y10T 403/7123; Y10T 403/7182; F16B 37/00; F16B 37/0814
USPC ..... 403/43, 53, 54, 55, 384, 389, 391, 396, 403/398, 399, 400; 292/251, 256, 300, 292/305, 337; 411/427, 433, 437; 248/68.1, 74.1, 74.4, 74.5, 286.1, 287.1, 248/292.14
See application file for complete search history.

(56) References Cited

U.S. PATENT DOCUMENTS 2,487,084 A * 11/1949 Weiss ..... F16B 21/16 411/347
4,192,537 A * 3/1980 Laine ..... E05C 17/365 292/264
4,368,997 A * 1/1983 Shemtov ..... F16B 7/04 248/286.1
4,490,083 A * 12/1984 Rebish ..... F16B 5/02 411/338
4,598,951 A * 7/1986 Ono ..... B60R 22/203 280/801.2
6,254,302 B1 * 7/2001 Kraus ..... F16B 5/0628 248/221.12
6,338,167 B1 * 1/2002 Baker ..... A47K 13/26 4/234
7,651,057 B2 * 1/2010 Sedivy ..... F16L 3/237 248/68.1
7,850,215 B2 * 12/2010 Taubert ..... F16B 21/02 292/256
8,051,690 B2 * 11/2011 Camisasca ..... F16B 41/00 411/432
8,210,785 B1 * 7/2012 Gager ..... E03D 11/16 411/338
8,251,413 B2 * 8/2012 Ramsauer ..... E05C 9/22 292/251
2008/0179898 A1 7/2008 Juga et al.
2009/0127412 A1 * 5/2009 Kleege ..... E04B 2/827 248/214
2009/0267360 A1 * 10/2009 Anderson ..... E05B 63/0056 292/202
2010/0143066 A1 * 6/2010 Ramsauer ..... E05C 9/22 411/116
2010/0201136 A1 8/2010 Ramsauer
2010/0207405 A1 8/2010 Ramsauer

* cited by examiner

Fig. 1F
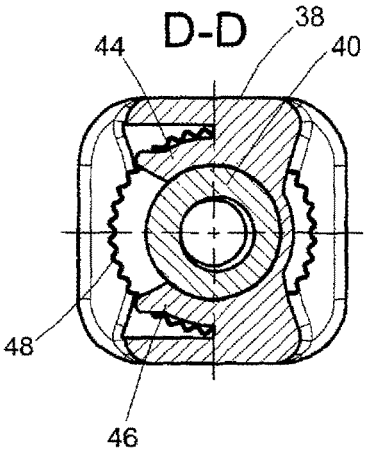
Fig. 1G
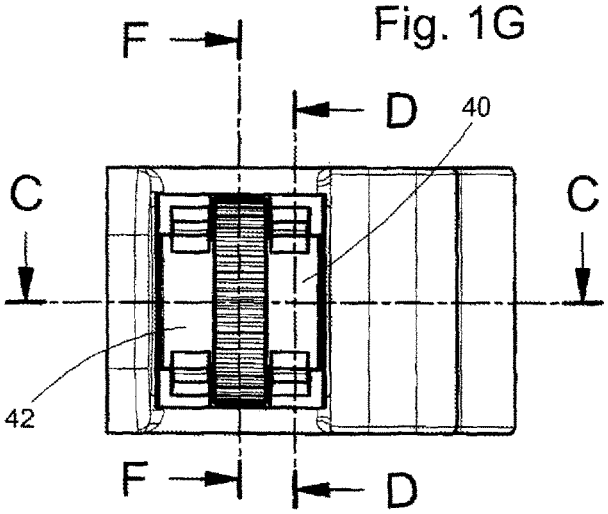
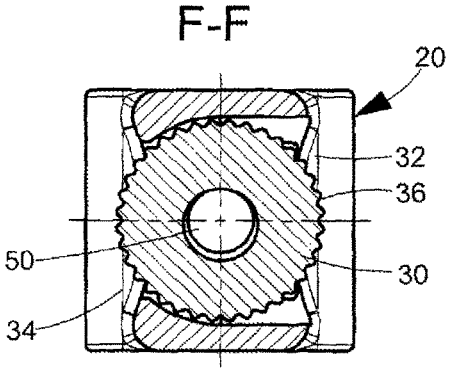
Fig. 1H
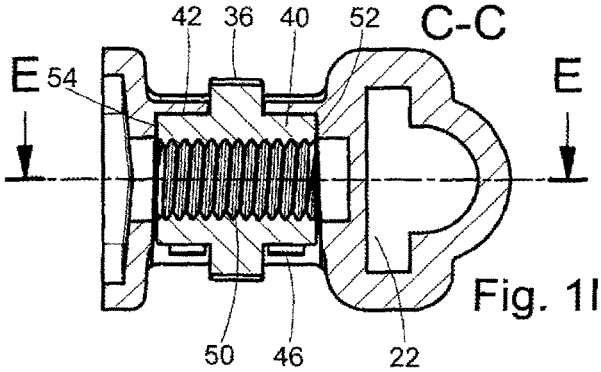
Fig. 1I
Fig. 1J
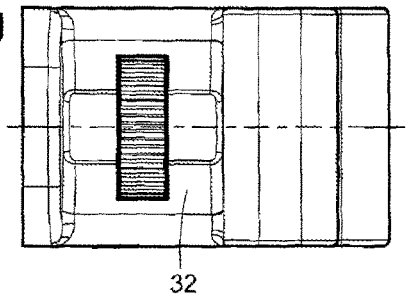
Fig. 1K
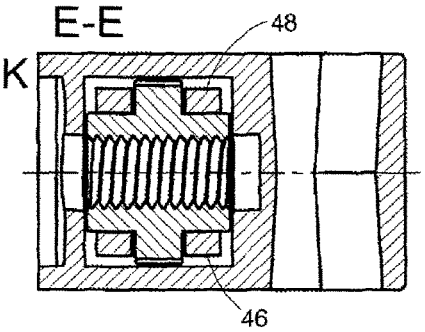

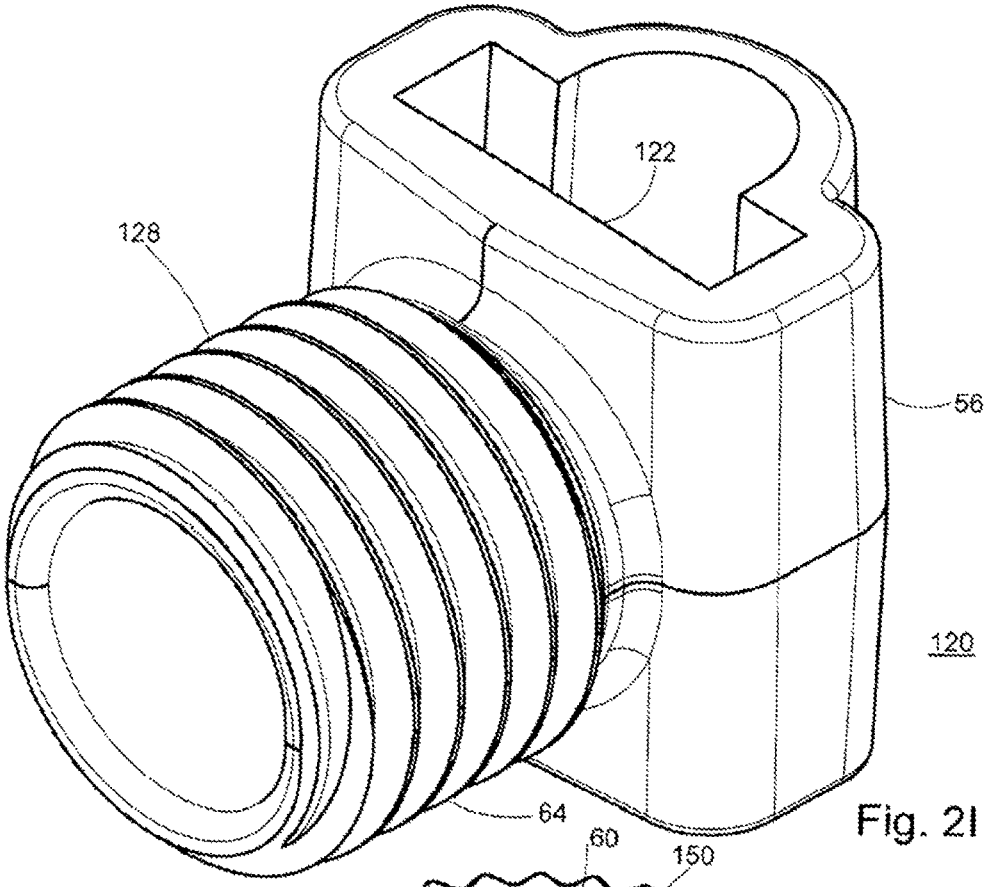
Fig. 2I
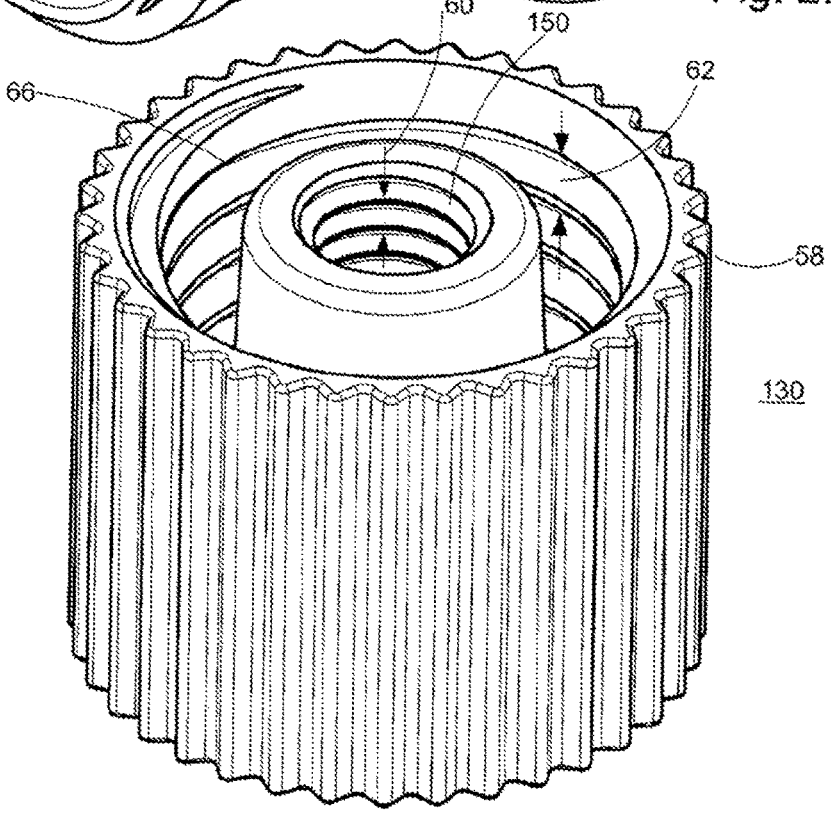

ROD GUIDE

The present application claims priority from PCT Patent Application No. PCT/EP2013/001841 filed on Jun. 21, 2013, which claims priority from German Patent Application No. DE 20 2012 007 098.3 filed on Jul. 21, 2012, the disclosures of which are incorporated herein by reference in their entirety.

1 FIELD OF THE INVENTION

The invention is directed to a rod guide for guiding lock rods at sheet metal cabinet doors or the like, comprising a carrier which can be fixed, e.g., spot-welded, on the inner surface of the door leaf, and a guide element which can be mounted on the carrier, which guide element forms a housing and has a guide surface having an adjustable distance from the inner surface of the door leaf when the rod is assembled, wherein the carrier which is spot-welded to the door leaf is a stud bolt with a circumferential thread, onto which stud bolt an adjusting screw or adjusting nut is screwed or can be screwed, and wherein the adjusting screw or the adjusting nut is rotatably supported at or in the guide element.

It is noted that citation or identification of any document in this application is not an admission that such document is available as prior art to the present invention.

A rod guide of the type mentioned above is already known, see DE 20 2007 005 424 U1. In this known construction of a rod guide having adjustability, it is disadvantageous that placing a screw or nut on the stud bolt and adjusting the distance of the guide surface from the door wall is laborious. The adjusting screw is arranged next to the rod, which leads to tilting forces. Further, the known rod guide requires a lot of space which is often not available.

A further disadvantage consists in that a tool, namely a screw driver, is required for adjusting the adjusting nut.

It is noted that in this disclosure and particularly in the claims and/or paragraphs, terms such as "comprises", "comprised", "comprising" and the like can have the meaning attributed to it in U.S. Patent law; e.g., they can mean "includes", "included", "including", and the like; and that terms such as "consisting essentially of" and "consists essentially of" have the meaning ascribed to them in U.S. Patent law, e.g., they allow for elements not explicitly recited, but exclude elements that are found in the prior art or that affect a basic or novel characteristic of the invention.

It is further noted that the invention does not intend to encompass within the scope of the invention any previously disclosed product, process of making the product or method of using the product, which meets the written description and enablement requirements of the USPTO (35 U.S.C. 112), such that applicant(s) reserve the right to disclaim, and hereby disclose a disclaimer of any previously described product, method of making the product, or process of using the product.

SUMMARY OF THE INVENTION

It is the object of the invention to avoid these disadvantages and to provide a rod guide which makes it possible to turn the adjusting screw or nut manually with few rotations and without a tool, requires little space and guides the rod coaxial to the carrier such as a welded stud.

The above-stated object is met in that the adjusting screw or adjusting nut has a circumferential surface for turning the adjusting nut or adjusting screw manually, which circumferential surface is accessible from the outside and is roughened or knurled or edged.

Adjustment is made considerably faster by means of these steps.

According to a further development of the invention, the housing forms one or two opposing orifices through which the circumferential surface projects outwards and can easily be gripped by the fingers of an operator.

According to a further arrangement, the one orifice, or at least one of the two orifices, is shaped in such a way that it allows the adjusting screw or the adjusting nut to be slid through laterally for assembly.

It is advantageous when the adjusting screw or adjusting nut is rotatably supported at both front sides in the housing so as to be fixed with respect to axial displacement.

According to yet another further development of the invention, the housing, in addition to being provided with the internal thread for the stud bolt having a first thread pitch (first threaded connection), is provided with a further (second) threaded connection with a second, larger thread pitch between the part of the rod guide forming the guide surfaces and the part of the rod guide which can be screwed on the stud bolt.

However, the further threaded connection can also be formed by a guide surface portion with external thread and a stud bolt portion with internal thread.

Alternatively, the further threaded connection can be formed by a guide surface portion with internal thread and a stud bolt portion with external thread.

The roughened or knurled or prismatic surface can be formed between the guide surface portion and the threaded connection portion.

The threads can also be arranged in such a way that they both work in the same direction when the nut is rotated and when the guide surface portion is fixed with respect to relative rotation.

Yet another further development is characterized in that the housing forms an undercut receiving space for supporting the adjusting screw or adjusting nut which in turn has a stub shaft which can be inserted laterally into the receiving space and has a protruding ring to be received in the undercut in a tongue-and-groove manner.

The receiving space can have a funnel-shaped entrance with flexible funnel walls for guiding the undercut portion of the stub shaft with a circular region adjoining the funnel for rotational support of the undercut portion of the stub shaft forming a circular cross section.

Yet another embodiment form of the rod guide is characterized in that a retaining nose which prevents or impedes the stub shaft from sliding out of the bearing support is arranged at the funnel entrance.

The housing and/or the adjusting screw or adjusting nut can be made of plastic (particularly PA, polyamide).

BRIEF DESCRIPTION OF THE DRAWINGS

FIG. 1F shows an enlarged sectional view along line D-D of FIG. 1G;

FIG. 1G shows an enlarged view of the rod guide according to FIG. 1C;

FIG. 1H shows a sectional view along line F-F of FIG. 1G;

FIG. 1I shows a sectional view along line C-C of FIG. 1G;

FIG. 1J shows a view similar to that in FIG. 1G, but from the other side;

FIG. 1K shows a sectional view along line E-E of FIG. 1I;

FIGS. 2A to 2E show views corresponding to FIGS. 1A to 1E of a further embodiment form of the invention;

FIG. 2I shows yet another enlarged view of the two portions of the arrangement according to FIG. 2A in perspective;

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do riot facilitate a better understanding of the present invention, a discussion of such elements is not provided herein.

The present invention will now be described in detail on the basis of exemplary embodiments.

Figure 1A:
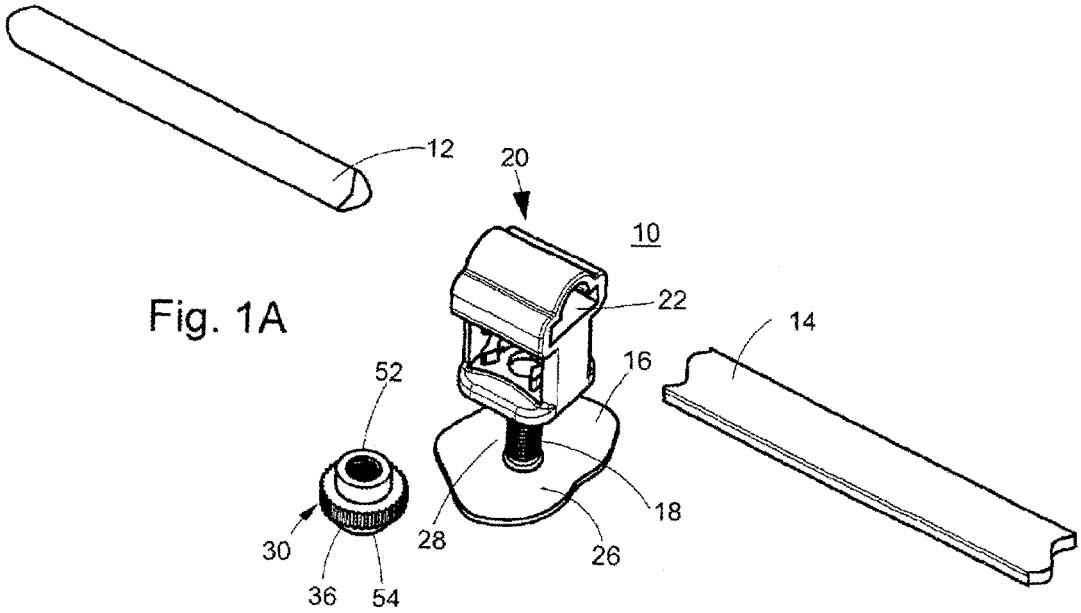
FIG. 1A shows an exploded view of a first embodiment form of the rod guide according to the invention.
Figure 1B:
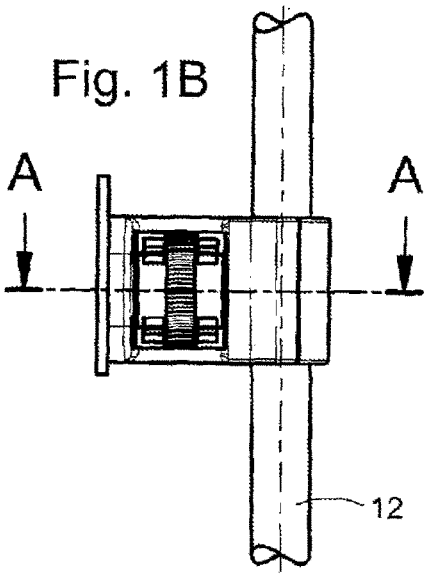
FIG. 1B shows a side view of the assembled rod guide with inserted rod.
Figure 1C:
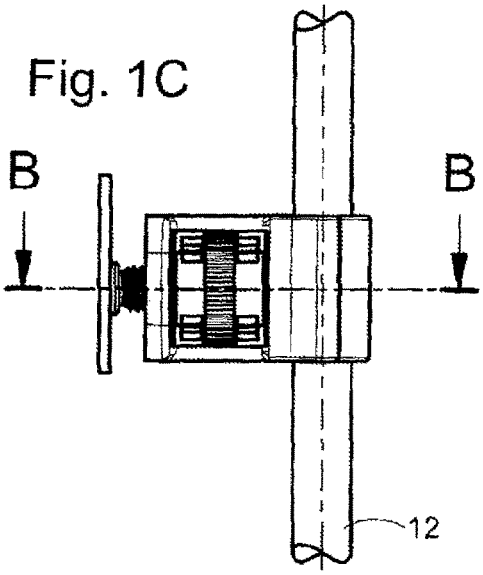
FIG. 1C shows the rod guide according to FIG. 1B, but in a different setting.
Figure 1D:
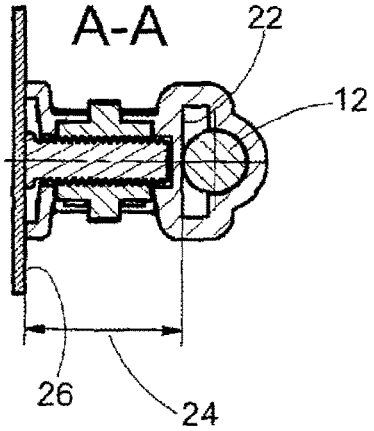
FIG. 1D shows a sectional view along line A-A of FIG. 1B.
Figure 1E:
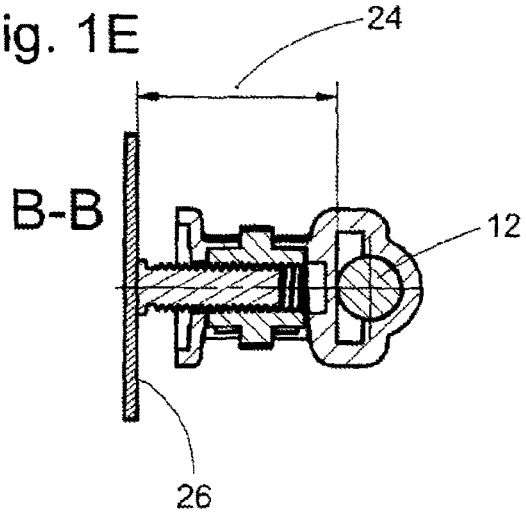
FIG. 1E shows a sectional view along line B-B of FIG. 1C.

FIG. 1A shows a perspective view of an exploded arrangement of a first embodiment form of the rod guide 10 according to the invention which is suitable for guiding a lock rod 12 (round rod) or 14 (flat band), namely at sheet metal cabinet doors 16 or the like, comprising a carrier 18 which can be fixed, e.g., spot-welded, on the inner surface of the door leaf 16, and a guide element which can be mounted on the carrier 18, which guide element forms a housing 20 and has a guide surface 22 having an adjustable distance 24—see FIG. 1D showing a sectional view along section line A-A of FIG. 1B—from the inner surface of the door leaf 16, wherein the carrier 18 which is welded or spot-welded to the door leaf is a stud bolt with a circumferential thread 28, onto which stud bolt 18 an adjusting screw or adjusting nut 30 is screwed (see FIG. 1D), and wherein the adjusting screw or the adjusting nut 30 is rotatably supported in the guide element or housing 20 as is shown in FIGS. 1B, 1C, 1D and 1E, wherein FIG. 1B shows the working position at a first distance position and FIG. 1C shows a working position with a larger distance 24, wherein the working position is reached by turning the adjusting nut 30, wherein the adjusting screw has a roughened or knurled or edged circumferential surface 36 which is accessible from the outside for rotating the adjusting nut or adjusting screw 30.

The housing 20 has two opposing orifices 32, 34 (FIG. 1H) through which the circumferential surface 36 of the adjusting screw or nut 30 is accessible from the outside, e.g., in order to turn by operating the adjusting screw or adjusting nut 30 with the fingers of the operator.

As can be seen from FIGS. 1F to 1I, at least one of the orifices 32, 34 is shaped in such a way that it allows the adjusting screw or the adjusting nut 30 to be slid through laterally for assembly thereof.

To this end, two axial projections 40, 42 emerge from the side walls of the adjusting screw or adjusting nut 30 for rotational support, which axial projections 40, 42 are held in a corresponding cavity in the housing 20 by housing walls 38 from which spring legs 44, 46 emerge. The spring legs 44, 46 flex away when the nut 30 is inserted owing to the conical receiving space 48 formed by them so that, after insertion and after the mounted position is achieved, the spring legs 44, 46 along with the side wall projections springingly wrap around the axial projection 40, 42 and rotatably support the nut 30 accordingly. The nut 30, including axial projections 40, 42, is drilled through and provided with an internal thread 50. This threaded bore hole 50 can receive the bolt with the circumferential thread 28, wherein the distance of the nut from the support surface of die thin wall 26 can be adjusted by the rotating process at the nut 30. The adjusting nut is supported on the housing ends by end faces 52, 54 and accordingly provides a stable connection between housing 20 and welded stud 18 on the one hand and housing 20 and guide surface 22 on the other hand.

Figure 2A:
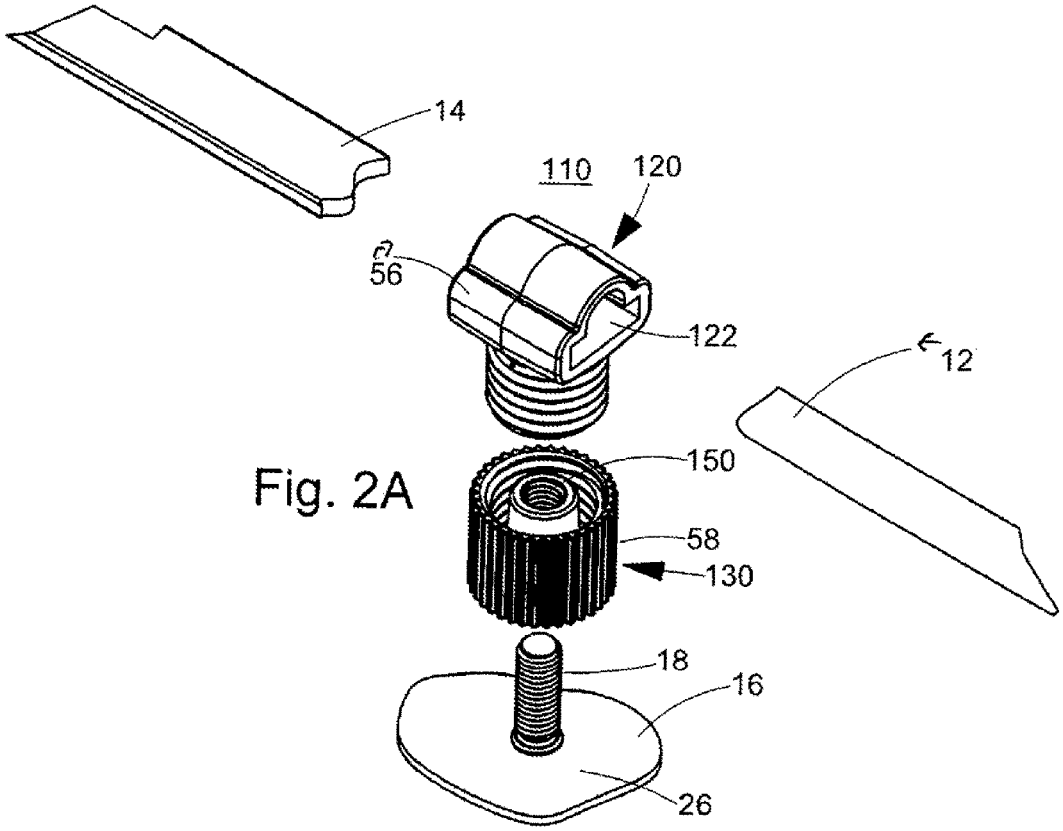
Figure 2B:
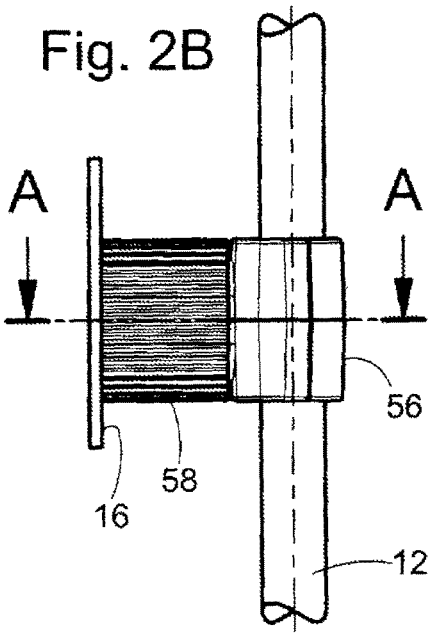
Figure 2C:
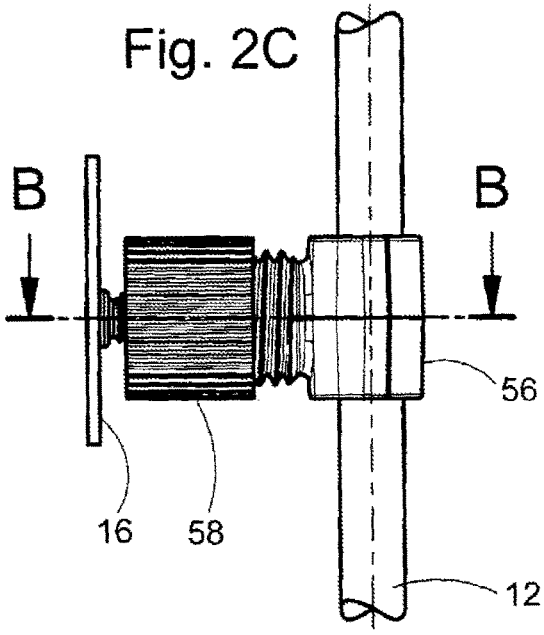
Figure 2C:
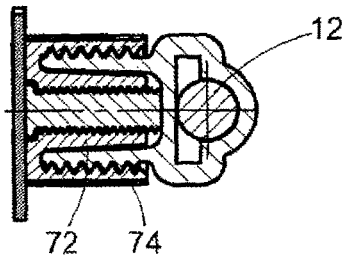
Figure 2C:
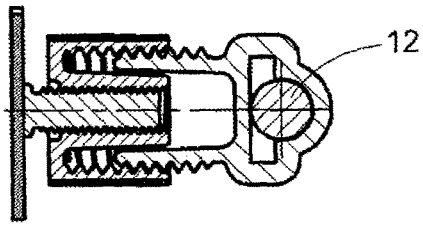
Figure 2F:
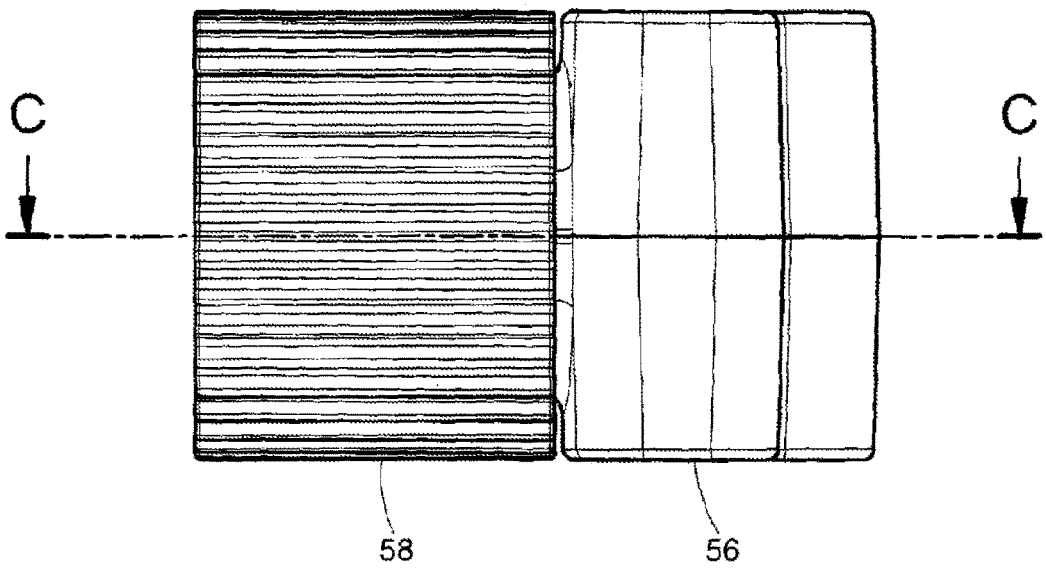
FIG. 2F shows an enlarged illustration of the side view of the rod guide of FIG. 2B.
Figure 2G:
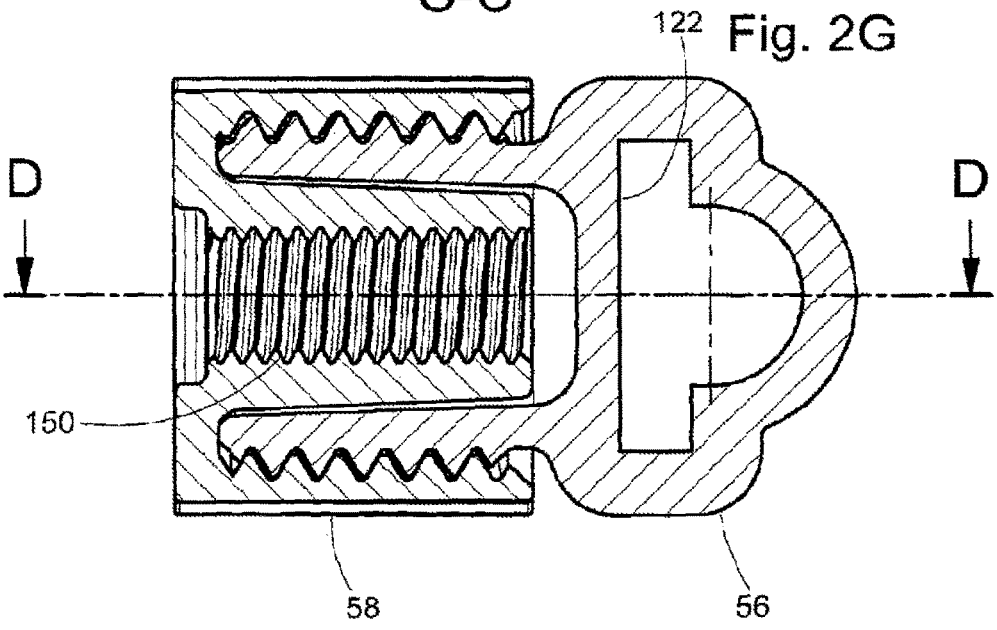
FIG. 2G shows a sectional view along line C-C of FIG. 2F.
Figure 2H:
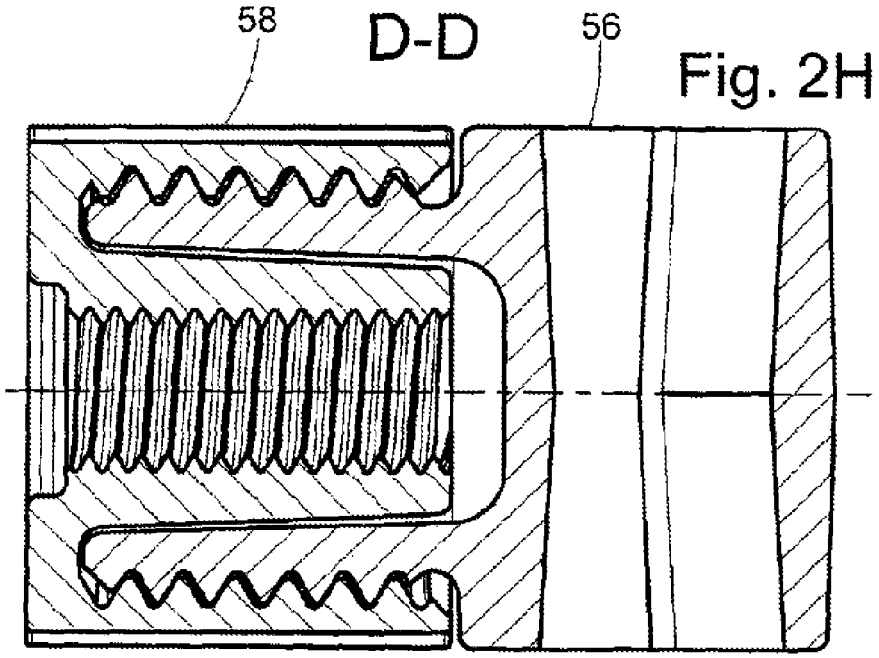
FIG. 2H shows a sectional view along line D-D of FIG. 2G.

FIGS. 2A to 2I show an embodiment form in which the housing 120—see particularly the embodiment form shown in FIG. 2A—is a rod guide 110 in which the housing 120, aside from being provided with the internal thread 150 for the stud bolt 18 with a first small thread pitch, is provided with a second, larger thread pitch with a further threaded connection between the part 56 forming the guide surfaces 122 and the part 58 which can be screwed onto the threaded bolt or stud bolt 18.

As a result of the different pitches of the two threaded connections, when the component part 130 is rotated, a small axial movement on the stud bolt 18 is realized in relation to a large axial movement of component part 130 on the thread 60 of part 56 in the same direction or in the opposite direction, depending on whether a left-hand thread or right-hand thread is required, resulting in a net displacement which is used to adjust the rod guide with respect to the distance of the rod guide from contact surface 122 and inner surface 26 of door leaf 16 without needing to remove the rod from the guide.

FIGS. 2A to 2I show an embodiment form in which the threaded connection of a guide surface part with external thread and a stud bolt part with internal thread is realized. When component part 130 is rotated, parts 120 and 130 are displaced in the same direction with respect to the stud bolt 18 as can be seen from FIGS. 2D and 2E.

In the embodiment form in FIGS. 3A to 3I, the threaded connection of a guide surface part with internal thread and a stud bolt part with external thread is formed.

In the embodiment form according to FIGS. 3A to 3I, the threaded connection is formed by a guide surface part with internal thread and a stud bolt part with external thread. The pitches are also different in this case so that there is an approximately three-fold net movement of the part 220 forming the guide surface 222 and the door leaf 26 relative to the movement on the stud bolt 18, which together results in a four-fold total movement.

Figure 3A:
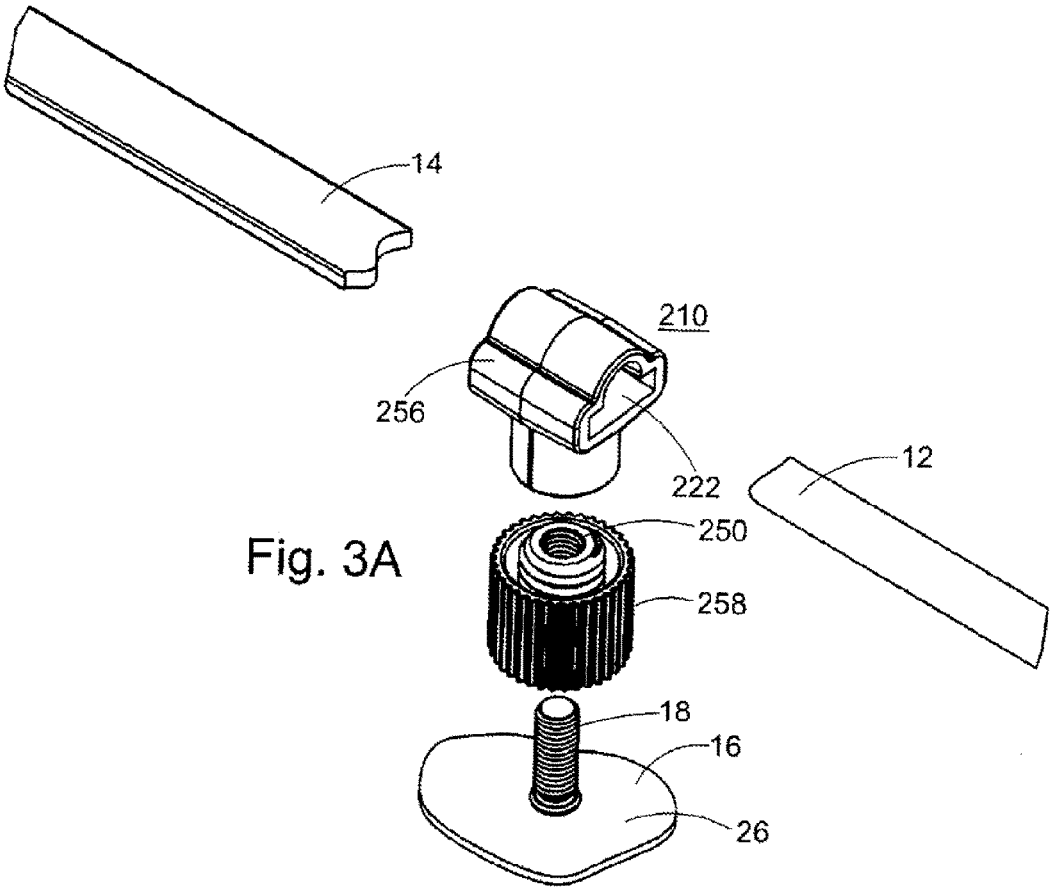
FIGS. 3A to 3E show views corresponding to FIGS. 2A to 2E of yet a further embodiment form of the invention.
Figure 3B:
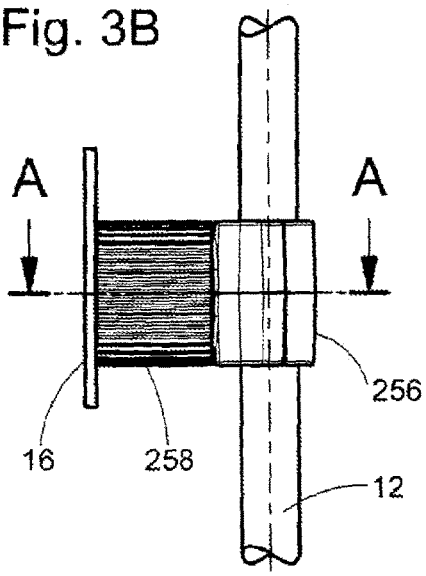
Figure 3C:
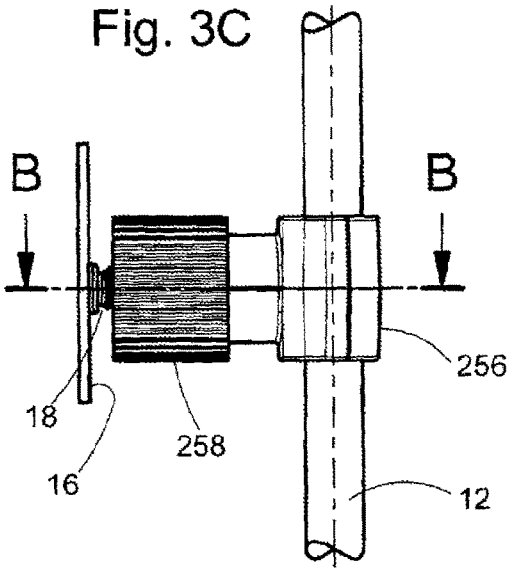
Figure 3D:
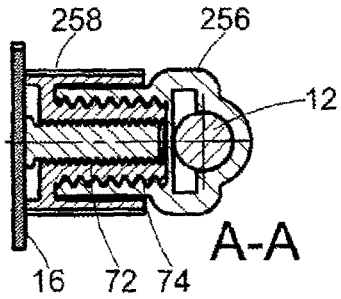
Figure 3E:
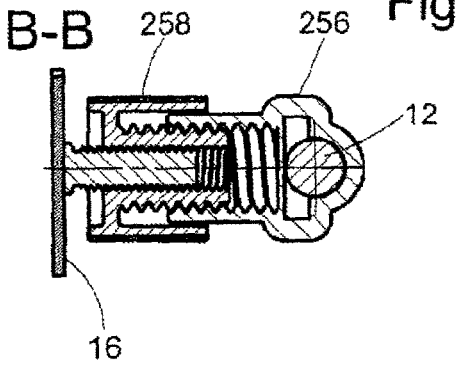
Figure 3F:
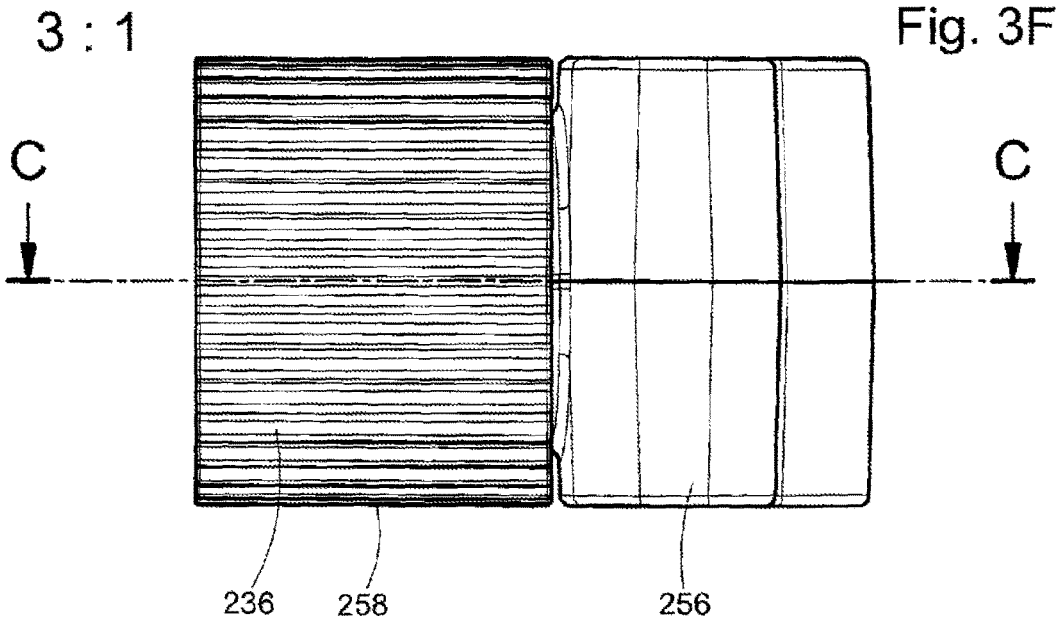
FIGS. 3F to 3I show views corresponding to FIGS. 2F to 2I.
Figure 3G:
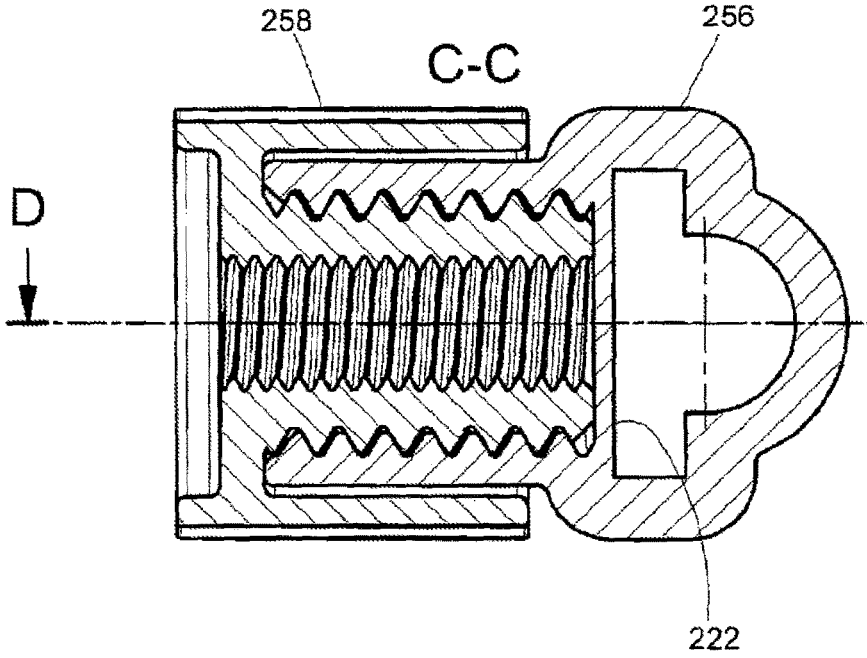
Figure 3H:
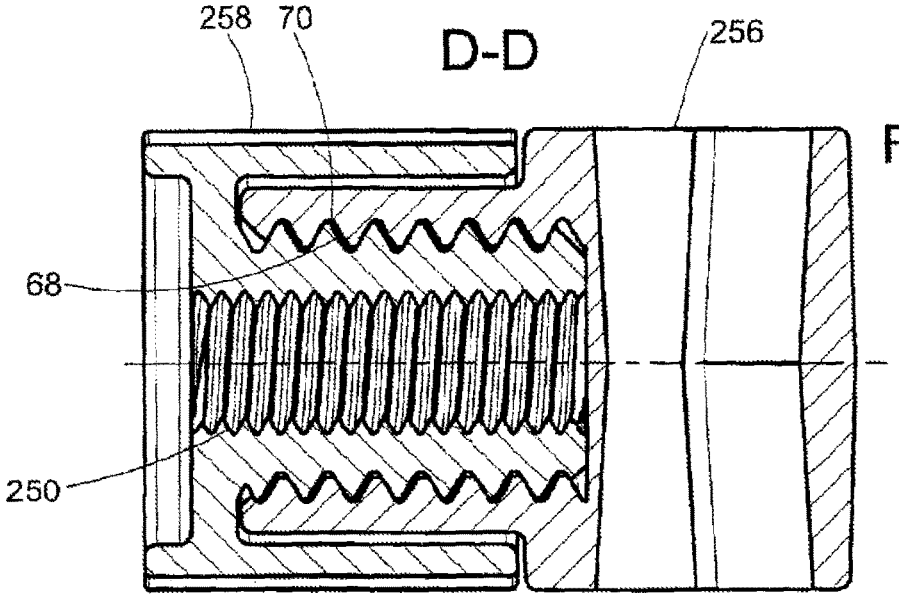
Figure 3I:
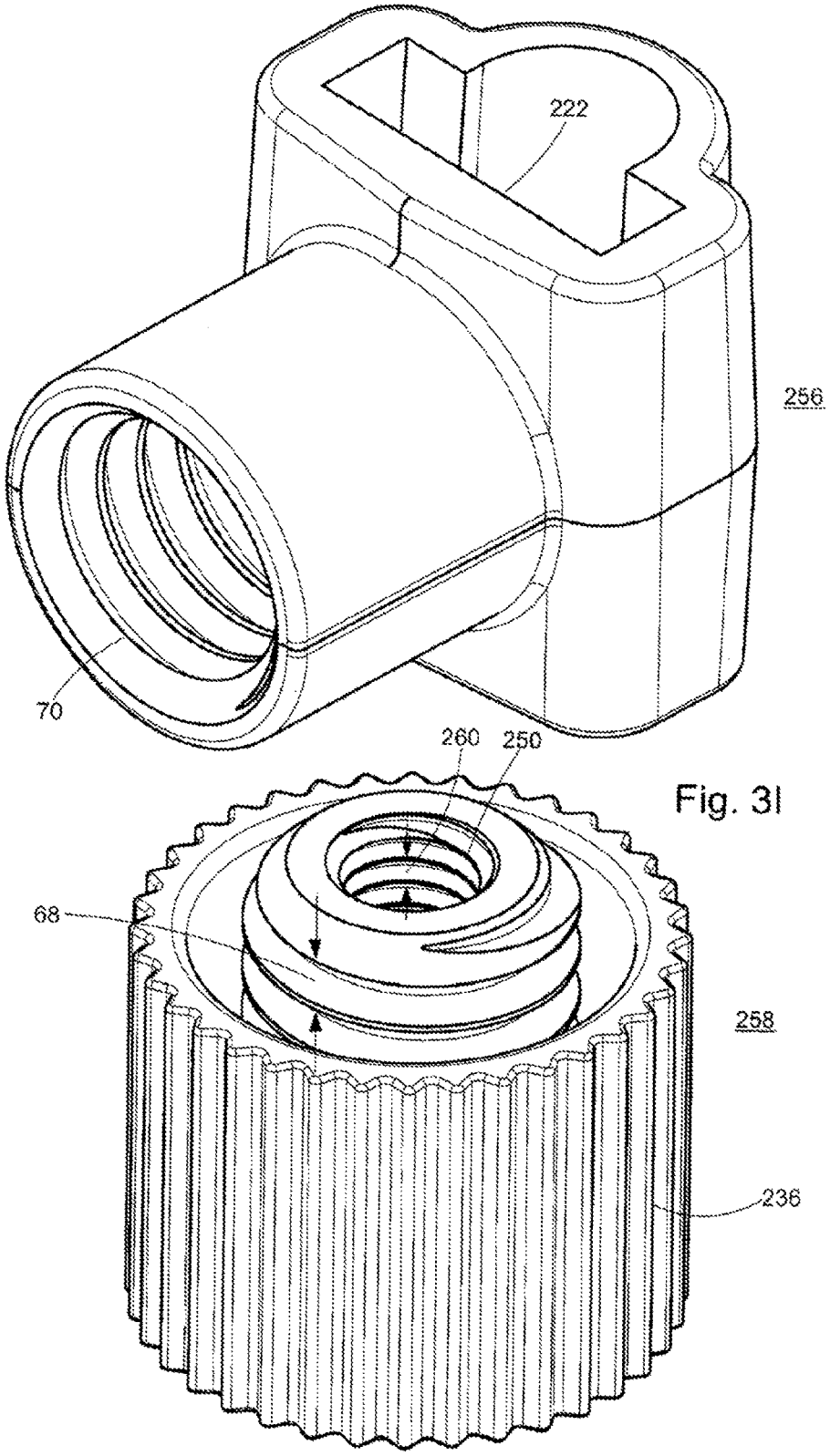

FIGS. 3B and 3D show a position with minimal distance, while FIGS. 3C and 3E show a certain distance.

Figure 4A:
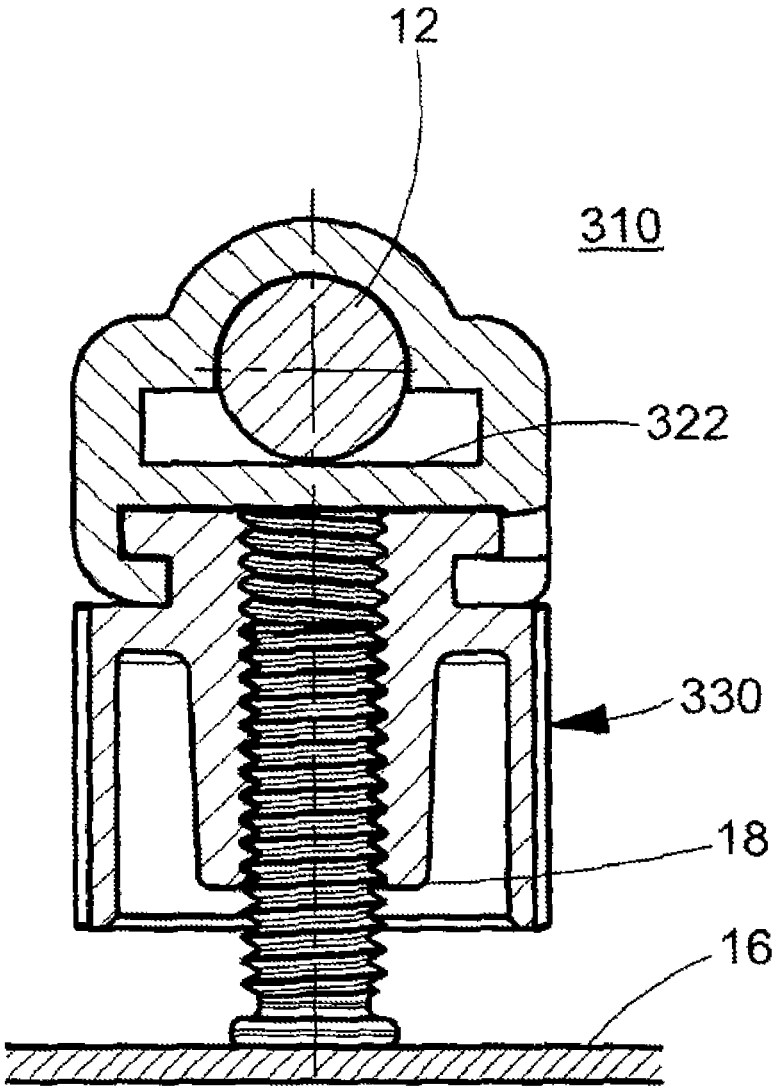
FIG. 4A shows an axial sectional view of yet another embodiment form.
Figure 4B:
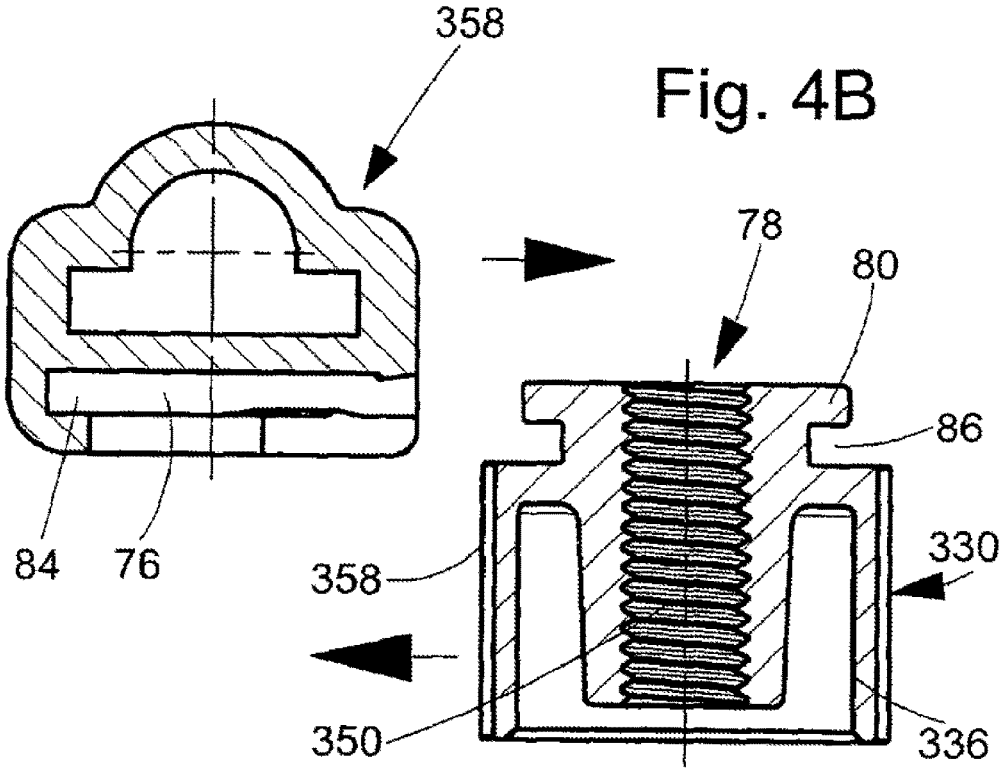
FIG. 4B shows the two parts of the rod guide prior to plugging together according to the arrows.

FIG. 4A shows an axial sectional view of yet another embodiment form of the rod guide 310 according to the invention which is likewise suitable for guiding a round rod 12 or a flat rod, not shown, or other shape of guide rod. In this case, the housing 356 comprises an undercut receiving space 76—see FIG. 4B—which serves to support the adjusting screw or adjusting nut 358 which in turn has a stub shaft 78 which can be inserted laterally into the receiving space 76 and has a protruding ring 80 to be received in the undercut 82 in the manner of a tongue-and-groove joint. Here again, a stud bolt 18 which can be screwed into a suitable threaded bore hole 350 by which the nut 30 can be screwed on serves as carrier. As can be seen from the top view in FIG. 4C, the receiving space 76 forms a funnel-shaped entrance 348 with flexible funnel walls 344, 346, wherein the flexibility is ensured through the choice of corresponding materials, e.g., PA or polyamide. After snapping into the undercut portion 82 of the stub shaft 78 with a circular region 84 adjoining the funnel 348 for rotational support of the undercut portion 86 of the stub shaft 78 forming a circular cross section, an axially rigid pivot bearing results.

Figure 4C:
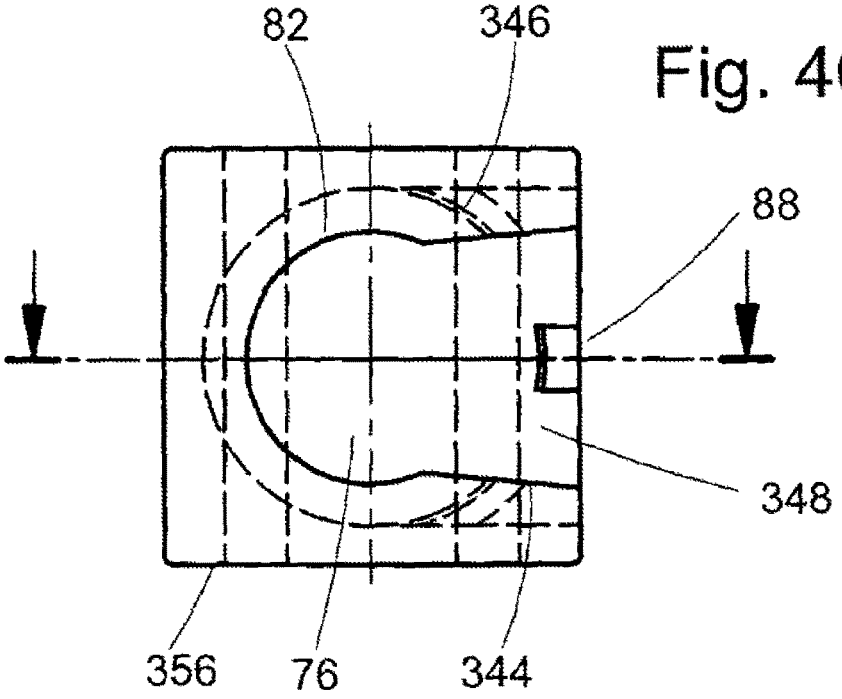
FIG. 4C shows a top view of the housing part.
Figure 4D:
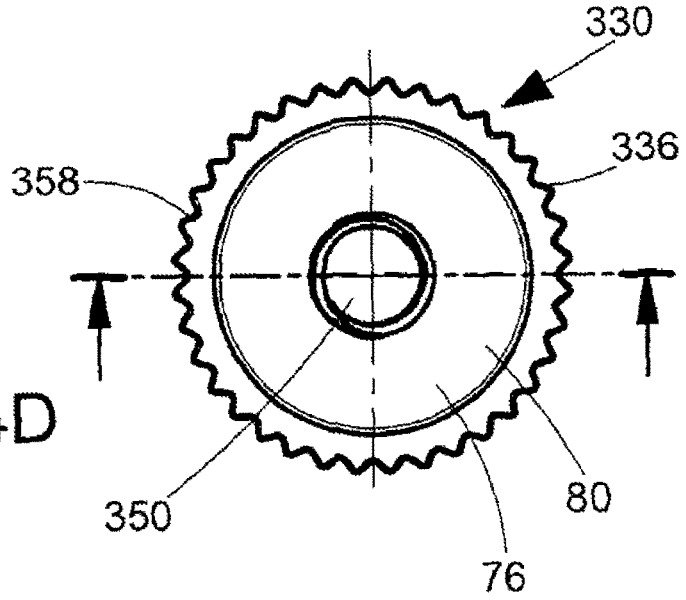
FIG. 4D shows a top view of the adjusting nut part.

A retaining nose 88—see FIG. 4C—can be provided at the entrance to the funnel, which retaining nose 88 prevents or impedes the stub shaft 78 from sliding out of the bearing 84 in that it abuts against the edge or ring 80 as can be seen from FIG. 4C. A similar effect is exhibited by the circular shape of the circular region 84 which extends over an angle of more than 180° and accordingly also forms a narrowing which strives to retain the inserted circular ring 86 and to release it only through a certain pressure such that, for example, it is possible to change the opening direction of the door, which involves a conversion of the lock rod 12.

At the same time, ring 80 in the component 358 forming the rod guide forms a pivot beating so that the nut 330 can be rotated with the fingers because of the rough surface 336, wherein the distance of the contact surface 322 from the plane 16 of the door leaf 16 is adjusted and it is accordingly possible to adapt to the respective conditions of the lock rod 12.

The invention is commercially applicable in switch cabinet construction, for example.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

LIST OF REFERENCE NUMERALS

10, 110, 210, 310 rod guide
12 lock rod (round)
14 lock rod (flat)
16 sheet metal cabinet door
18 carder
20, 120 housing
22, 122, 222 guide surface
24 distance
26 inner surface
28 circumferential thread
30, 130 adjusting screw, adjusting nut
32 orifice
34 orifice
36, 136, 336 circumferential surface
38 housing wall
40 axial projection
42 axial projection
44, 344 spring leg
46, 346 spring leg
48, 348 funnel aperture
50, 150, 250, 350 threaded bore hole
52 end trace
54 end face
56, 256, 356 first portion (forms the guide surfaces)
58, 258, 358 second portion (can be screwed onto stud bolt)
60, 260 first thread pitch
62 second thread pitch
64 external thread
66 internal thread
68 external thread
70 internal thread
72 first threaded connection
74 second threaded connection
76 receiving space, undercut
78 stub shaft
80 ring
82 undercut
84 circular region
86 undercut area
88 retaining nose

The invention claimed is:

1. A rod guide for guiding a lock rod at a sheet metal cabinet door, comprising:

a carrier configured to be fixed on an inner surface of a door leaf, the carrier comprising:

a stud bolt or welded stud with a circumferential thread; and a guide element configured to be mounted on the carrier, the guide element comprising:

a housing;

an opening in the housing, the opening being configured to accept the lock rod and having a guide surface with an adjustable distance from the inner surface of the door leaf when the rod guide is assembled and fixed to the inner surface of the door leaf; and an adjusting screw or adjusting nut which is rotatably supported in the housing;

wherein the adjusting screw or adjusting nut is screwed onto the stud bolt or welded stud in an axial direction; and wherein the adjusting screw or adjusting nut has a circumferential surface that is formed in the axial direction between the guide surface and the inner surface of the door leaf, and which is accessible from outside the housing and is roughened or knurled or edged or prismatic.

2. The rod guide according to claim 1;

wherein the housing comprises an orifice through which the circumferential surface projects outwards.

3. The rod guide according to claim 2;

wherein the orifice is shaped in such a way that it allows the adjusting screw or the adjusting nut to be slid through laterally for assembly thereof in the housing.

4. The rod guide according to claim 1;

wherein the adjusting screw or adjusting nut is rotatably supported at a front side thereof in the housing so as to be fixed with respect to axial displacement.

5. The rod guide according to claim 1;

wherein the guide element further comprises:

an internal threaded connection having a first thread pitch for forming a first threaded connection with the circumferential thread of the stud bolt or welded stud; and a second threaded connection, having a second thread pitch which is larger than the first thread pitch, arranged between a part guide element forming the guide surface and a part of the guide element which is screwed on the stud bolt or welded stud.

6. The rod guide according to claim 5;

wherein the second threaded connection is formed by a guide surface portion with external thread and a stud bolt portion with internal thread.

7. The rod guide according to claim 5;

wherein the second threaded connection is formed by a guide surface portion with internal thread and a stud bolt portion with external thread.

8. The rod guide according to claim 6 or 7;

wherein the threads of the first and second threaded connections are arranged in such a way that they both work in the same direction when the nut is rotated and when the guide surface portion is fixed with respect to relative rotation.

9. The rod guide according to claim 1;

wherein the housing forms an undercut receiving space configured to support the adjusting screw or adjusting nut; and wherein the adjusting screw or adjusting nut comprises a stub shaft configured to be inserted laterally into the receiving space; and wherein the stub shaft comprises a protruding ring configured to be received in an undercut of the undercut receiving space in a tongue-and-groove manner.

10. The rod guide according to claim 9;

wherein the stub shaft further comprises an undercut portion from which the protruding ring protrudes; and wherein the receiving space has:

a funnel-shaped entrance with flexible funnel walls configured to guide the undercut portion of the stub shaft; and a circular region which adjoins the funnel-shaped entrance and is configure to rotationally support the undercut portion of the stub shaft.

11. The rod guide according to claim 10;

wherein the housing includes a retaining nose, which prevents or impedes the stub shaft from sliding out of the circular region, that is arranged at the funnel-shaped entrance.

12. The rod guide according to one of claims 1 and 9 to 11;

wherein at least one element selected from the group consisting of the housing, the adjusting screw, and adjusting nut is made of plastic.

* * * * *